United States Patent [19]

Stickles, Sr.

[11] Patent Number: 4,991,357

[45] Date of Patent: Feb. 12, 1991

[54] KNIFE SHARPENING KIT

[76] Inventor: Donald L. Stickles, Sr., 36 Nessrala Dr., Brockton, Mass. 02402

[21] Appl. No.: 498,429

[22] Filed: Mar. 26, 1990

[51] Int. Cl.[5] ..... B24B 15/08

[52] U.S. Cl. ..... 51/214; 51/211 R; 51/285

[58] Field of Search ..... 76/82, 88; 51/285, 158, 51/211 R, 211 H, 212, 213, 214

[56] References Cited

U.S. PATENT DOCUMENTS

| | | | |
|---|---|---|---|
| 185,286 | 12/1876 | Brook | 51/285 |
| 564,403 | 7/1896 | Whitney | 51/214 |
| 582,544 | 5/1897 | Olives | 51/213 |
| 736,245 | 8/1903 | Goodfellow | 51/214 |
| 1,202,113 | 10/1916 | Smith | 51/285 |
| 1,294,616 | 2/1919 | Carlson | 51/211 R |
| 1,619,581 | 3/1927 | Long | 51/285 |
| 3,135,383 | 6/1964 | Block . | |
| 3,623,280 | 11/1971 | Chesnut | 51/211 R |

FOREIGN PATENT DOCUMENTS

| | | | |
|---|---|---|---|
| 468564 | 1/1935 | United Kingdom | 51/214 |

*Primary Examiner*—Frederick R. Schmidt
*Assistant Examiner*—Blynn Shideler

[57] ABSTRACT

A mechanism for sharpening knife blades, including a portable case that forms an elongated trough for supporting (positioning) a rectangular cutting stone. Outwardly flaring support surfaces are formed on the case at upper edges of the trough. During a sharpening operation the knife blade is held flatwise against one of the support surfaces with the edge of the blade in contact with the upper surface of the cutting stone. The blade is moved back and forth so that the blade edge has grinding frictional contact with the stone surface. The angular tilt of the support surface relative to the plane of the stone upper surface determines the angle formed on the knife blade by the sharpening process.

1 Claim, 1 Drawing Sheet

KNIFE SHARPENING KIT

BACKGROUND AND SUMMARY OF THE INVENTION

This invention relates to a mechanism for manually sharpening knife blades. The mechanism comprises a portable case that defines an upwardly facing trough adapted to removably receive a cutting stone. Upper wall areas of the case proximate to the trough flare outwardly and upwardly to form support surfaces for knife blades to be sharpened.

A knife blade is sharpened by resting the blade flatwise on one of the flaring support surfaces, with the cutting edge of the blade in contact with an upper flat face of the cutting stone (located within the trough). The knife is then moved back and forth parallel to the trough axis, such that the blade cutting edge experiences a grinding engagement with the stone surface.

The flaring support surfaces on the case are angled to the exposed surface of the stone at about twenty seven degrees. By keeping the blade in flatwise engagement with a support surface it is possible to form a precise cutting angle on the blade edge. The case is formed with two flaring support surfaces at each side edge of the cutting stone; the knife blade can be selectively (sequentially) engaged with the two surfaces to form a V-shaped cutting edge on the blade.

The mechanism is designed as a relatively low cost device for obtaining a relatively sharp precise cutting edge on a knife blade. The device can be used on a variety of different sized knife blades. In a preferred form of the invention the cutting stone and trough structure are designed so that the stone can be reoriented in the trough with different flat surfaces of the stone facing upwardly to serve as blade grinding surfaces. This feature somewhat increases the useful life of the mechanism. Also, it permits the stone to be formed with coarse and fine grinding surfaces, thereby permitting relatively dull knife blades to be sharpened in a minimum time period (by first using the coarse surface and then using the fine surface).

THE DRAWINGS

DESCRIPTION OF A PREFERRED EMBODIMENT OF THE INVENTION

Figure 2:
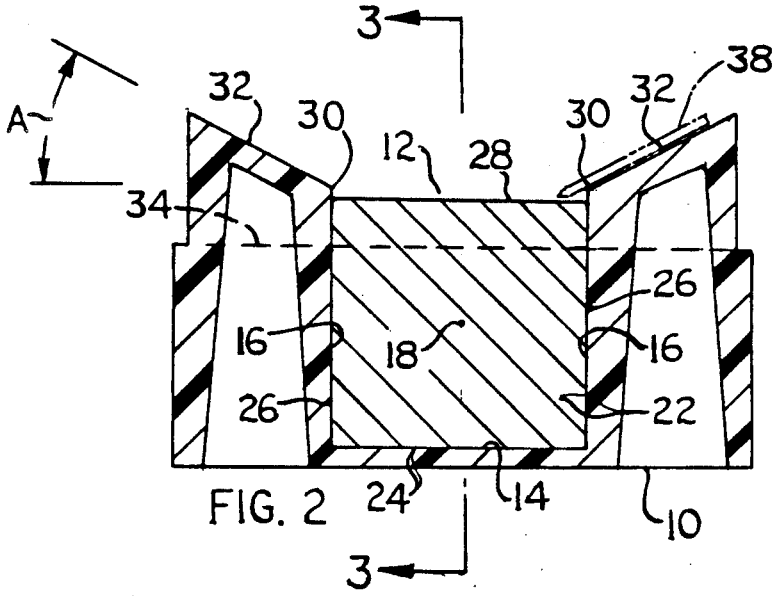
FIG. 2 is a sectional view taken in the same direction as FIG. 1, but illustrating another form that the invention can take.

FIG. 2 shows one form of the invention that comprises a case structure 10 formed to define an upwardly facing trough 12. This trough comprises an internal flat bottom surface 14 and two upstanding flat internal side surfaces 16 arranged in facing relation.

Figure 3:
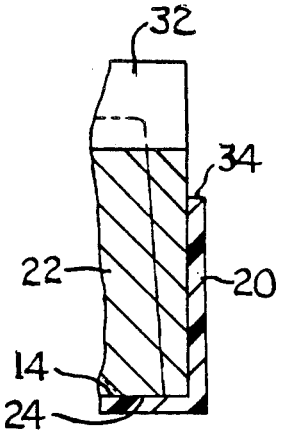
FIG. 3 is a fragmentary sectional view taken on line 3—3 in FIG. 2.

FIG. 2 is a transverse sectional view taken through the trough; the trough is elongated normal to the plane of the paper. Typically the length of the trough (normal to the plane of the paper) can be five or six inches; the transverse width of the trough (distance between surfaces 16, 16) can be about one and one half inches. In FIG. 2 the central longitudinal axis of the trough is designated by numeral 18. Case structure 10 has two end walls defining the end limits of the trough. In FIG. 3 one of the case end walls is designated by numeral 20.

A rectangular cutting stone 22 is removably disposed within trough 12, such that the stone has minimal clearance with respect to the adjacent trough 12 surfaces. The stone will not shift in the trough, but it can be removed merely by manually overturning case structure 10. Stone 22 has a flat bottom surface 24, two flat side surfaces 26, and a flat upper surface 28. In use of the mechanism the upper surface of the stone constitutes a grinding surface.

Case structure 10 is dimensioned so that upper edges 30 of internal surfaces 16 are located a slight distance above the plane of stone upper surface 28. Two flat blade-support surfaces 32 extend from edges 30 away from the central longitudinal axis of trough 12. Surfaces 32 are coextensive in length with the length of the trough and the associated cutting stone 22.

Each blade-support surface 32 is angled upwardly and outwardly away from trough axis 18 at an angle A that measures about twenty seven degrees. Numeral 38 in FIG. 2 shows in phantom lines a conventional knife blade positioned flatwise one of the support surfaces 32, with the cutting edge of the blade in contact with stone surface 28. To sharpen the blade cutting edge the blade is moved longitudinally back and forth along support surface 32 while the blade cutting edge remains in frictional contact with stone surface 28. This back-and-forth motion produces a grinding (sharpening) action on the blade cutting edge.

Each blade support surface 32 serves to orient the knife blade so that each motion of the blade (into or out of the plane of the paper in FIG. 2) produces a repetitive grinding action on the same surface areas of the blade. A relatively precise cutting angle of about twenty seven degrees is formed on each side edge of the blade.

The purpose in having two blade support surfaces 32 is to facilitate a grinding action along each face of the knife blade. When both side faces of the blade are sharpened the blade will have a V-shaped cutting edge, as indicated generally in FIG. 2. The use of two support surfaces 32 permits a right handed person to face the case structure 10 and grip the knife handle in his/her right hand while using the left hand to hold the blade on the rightmost support surface 32 (FIG. 2); this procedure is used to sharpen one of the blade side edges. Then the blade is reoriented so that the upper face of the knife blade becomes the lower face (but turned over to lie against the leftmost support surface 32); this procedure is used to sharpen the other face of the blade cutting edge.

Cutting stone 22 may be constructed to have a square cross section, such that each of the four stone surfaces 24, 26, 26, and 28 has the same cross-sectional length and spacing from the stone central axis. With such a construction the stone can be repositioned in trough 12 so that any one of the four stone surfaces face upwardly in a position to act as a grinding (sharpening) mechanism. This feature advantageously increases the useful service life of the case-stone assembly.

As seen in FIG. 3, the upper edge 34 of case structure end wall 20 is located below the plane of the exposed stone surface 28. This is to avoid any obstructions to longitudinal movement of the knife blade along the sharpening surface and associated support surface 32. It will be seen from FIG. 2 that the knife blade contacts the stone surface at a point spaced away from the corner of the stone. Any roundness of the stone corner will not have an adverse effect on the sharpening process; the knife blade will be in contact with a flat stone surface. Case structure 10 is dimensioned so that edges 30 are only slightly above the plane of the cutting surface 28, e.g. less than one quarter inch above surface 28.

Figure 1:
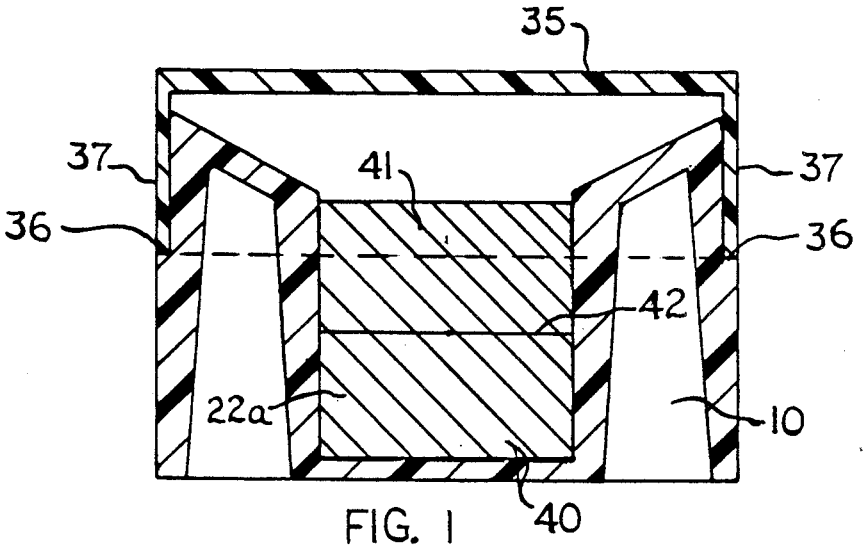
FIG. 1 is a sectional view taken through a knife blade sharpening mechanism constructed according to the invention.

When the cutting stone is not in use a hollow cover may be placed over case structure 10 to enclose the cutting stone. FIG. 1 shows a hollow cover structure 35 that can be used. Case 10 is formed with an external shoulder 36 extending therearound. The removable cover structure 35 has a depending peripheral flange 37 adapted to fit around the upper portions of case structure 10 so that the lower edge of the flange abuts against peripheral shoulder 36. The side surfaces of cover flange 37 are then flush with the outer external side surfaces of the case structure.

FIG. 1 shows an arrangement that is structurally similar to the FIG. 2 structure except for the construction of the cutting (grinding) stone. In the FIG. 1 arrangement cutting stone **22*a* is formed by two rectangular slab elements 40 and 41 adhesively secured together to form a slab interface 42**. One slab element is formed of relatively large size abrasive particles for defining a coarse (rough) grinding surface. The other slab element is formed of relatively fine (small) abrasive particles for defining a relatively fine grinding surface.

When it is desired to sharpen an especially dull knife blade the cutting stone **22*a* can first be oriented so that its coarse grinding surface is facing upwardly in trough 12. After the blade edge has been sharpened as much as possible with the coarse grinding surface, stone 22*a*** can be reoriented so that its fine grinding surface is facing upwardly. The blade cutting edge can then be further sharpened to form a somewhat sharper V-shaped cutting edge. The use of two grinding surfaces of different abrasive character can somewhat shorten the total sharpening time and manual effort.

The illustrated mechanisms are relatively low in cost, while being effective to achieve relatively precise V-shaped cutting edges on knife blades without requiring any extraordinary skill on the part of the person performing the sharpening operation.

I claim:

1. A mechanism for sharpening knife blades, comprising:

a case defining a hollow rectangular trough having a central horizontal axis; said trough comprising a flat internal bottom surface (14) and two flat internal side surfaces (16) extending upwardly from said bottom surface in facing relation; the cross-sectional width dimension of said internal bottom surface being slightly less than the cross-sectional width dimension of each said internal side surface;

and a square-cross sectioned cutting stone removably seated in said trough; said cutting stone having four similarly dimensioned side surfaces, each side surface of the stone having the same cross-sectional width dimension as that of the trough bottom surface, whereby the stone can be immovably positioned in the trough with any one of its side surfaces presented upwardly to form the stone upper surface; the cross-sectional dimensions of the trough side surfaces being such that the upper edges thereof are located a discernible distance above the plane of the stone upper surface;

said case further comprising two flat blade-support surfaces (32) extending from the upper edges of the trough side surfaces away from the trough central axis; said flat blade-support surfaces being angled upwardly and outwardly away from the respective internal side surfaces of the trough, whereby when a knife blade is held flatwise against either blade-support surface and moved so that its cutting edge is in frictional contact with the upper surface of the stone a sharpening action is achieved on the blade cutting edge;

the cross-sectional dimension of each blade-support surface being at least one half the cross-sectional width dimension of the stone upper surface, whereby a knife blade can be held flatwise against either blade-support surface without wobbling or changing its angle relative to the upper surface of the cutting stone.

* * * * *